US009599071B2

(12) United States Patent
Dudar

(10) Patent No.: US 9,599,071 B2
(45) Date of Patent: Mar. 21, 2017

(54) SYSTEMS AND METHODS FOR CANISTER FILTER DIAGNOSTICS

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 93 days.

(21) Appl. No.: 14/729,825

(22) Filed: Jun. 3, 2015

(65) Prior Publication Data

US 2016/0356247 A1 Dec. 8, 2016

(51) Int. Cl.
*F02M 25/08* (2006.01)

(52) U.S. Cl.
CPC .... *F02M 25/0827* (2013.01); *F02M 25/0809* (2013.01); *F02M 25/0836* (2013.01)

(58) Field of Classification Search
CPC ..... F02M 25/0809; F02M 25/089; F02M 25/0836
USPC ..... 123/516–520
See application file for complete search history.

(56) References Cited

U.S. PATENT DOCUMENTS 5,275,144 A * 1/1994 Gross ..... F02M 25/0809 123/198 D
5,297,529 A * 3/1994 Cook ..... F02M 25/0818 123/198 D
5,317,909 A * 6/1994 Yamada ..... F02M 25/0809 123/520
5,494,021 A * 2/1996 Yoneyama ..... F02M 25/0809 123/520
5,890,474 A * 4/1999 Schnaibel ..... F02M 25/0818 123/198 D
6,112,728 A * 9/2000 Schwegler ..... F02M 25/0818 123/198 D
6,131,550 A * 10/2000 Fritz ..... F02M 25/0818 123/198 D
6,196,202 B1 * 3/2001 Busato ..... F02M 25/089 123/198 D
6,536,261 B1 3/2003 Weldon et al.
6,845,652 B2 * 1/2005 Stegmann ..... F02M 25/0818 702/51
6,951,126 B2 * 10/2005 Perry ..... F02M 25/0809 73/49.7
7,284,530 B2 * 10/2007 Nagasaki ..... F02M 25/0818 123/198 D
7,363,803 B2 * 4/2008 Hayakawa ..... F02M 25/0809 123/499
8,560,167 B2 * 10/2013 Jentz ..... G01M 3/025 180/441
2014/0260576 A1 9/2014 Sweppy et al.
2015/0142293 A1 5/2015 Dudar et al.

* cited by examiner

*Primary Examiner* — Thomas Moulis
(74) *Attorney, Agent, or Firm* — James Dottavio; John D. Russell; B. Anna McCoy

(57) ABSTRACT

Methods and systems are provided for diagnosing a filter integrated within a fuel vapor canister. In one example, a method may include diagnosing restriction of a canister filter based on a duration to reduce a pressure in an evaporative emissions control system including the canister to a reference pressure, and further based on an initial pressure difference across the canister when a canister purge valve is opened when the evaporative emissions control system is at the reference pressure.

20 Claims, 6 Drawing Sheets

SYSTEMS AND METHODS FOR CANISTER FILTER DIAGNOSTICS

FIELD

The present description relates generally to methods and systems for diagnosing a filter integrated within a fuel vapor canister.

BACKGROUND/SUMMARY

Vehicles may be fitted with evaporative emission control systems to reduce the release of fuel vapors to the atmosphere. For example, evaporative emissions control systems may include a carbon canister coupled to a fuel tank for adsorbing refueling, diurnal and running loss hydrocarbon vapors from the fuel tank during engine-off conditions. At a later time when the engine is in operation, a canister purge valve coupled within a purge line coupling the canister and the engine intake manifold is opened, which allows the vapors to be purged into the engine intake manifold for use as fuel.

Activated carbon inside the canister is used to adsorb the vaporized hydrocarbons. The carbon comprises of tiny pellets that have microscopic pores to trap the hydrocarbons. Over time, carbon dust breaks away from the pellets and migrate to the purge valve. Consequently, leaks may occur in the purge valve. Leaky purge valves are expensive to replace and may cause damages to the fuel tank.

In order to mitigate carbon dust migration from the canister to the purge valve, a canister filter may be employed within the canister near a purge port to trap the carbon dust and therefore prevent the carbon dust from clogging the purge valve. However, the canister filter may become restricted over a period of time. For example, activated carbon breakdown due to liquid fuel entering the canister may cause the canister to clog. When the canister filter is restricted, the engine vacuum may not be able to reach the canister, thereby resulting in failed purging operations. The inability to purge causes the canister to saturate, which leads to increased hydrocarbon breakthrough to the atmosphere, and hence increased evaporative emissions. Further, evaporative emissions leak diagnostics that use engine vacuum to evacuate fuel tank and perform bleed up analysis may be affected due to the clogged carbon filter preventing the engine vacuum from being applied to the tank. Still further, in hybrid vehicles, a highly restrictive canister filter may impede fuel tank depressurization prior to a refueling sequence.

The inventors herein have recognized the above issues, and have developed systems and methods to at least partially address them. In one example, a method, comprising: indicating restriction of an integrated filter of a carbon canister responsive to a duration for a pump disposed in a vent line between the canister and atmosphere to reduce a pressure of an evaporative emissions control system to a reference pressure being less than a first threshold duration. In this way, diagnostics may be performed to determine if the filter is clogged.

As an example, during engine-off conditions, an ELCM pump disposed in a vent line between the canister and atmosphere may be operated to evacuate a portion of the evaporative emissions control system with the purge valve and the FTIV closed (also referred to herein as canister side of the evaporative emissions control system). As such, a duration to reach a reference pressure is proportional to the volume in the system. Therefore, if the canister filter is fully restricted, a purge line between the purge valve and a purge port of the canister cannot be evacuated by the ELCM pump due to the clogged filter blocking accessibility to the purge line. Since the purge line between the purge port and the purge valve has considerable volume, when the canister filter is fully restricted, a volume of the emissions control system that is available for evacuation by the ELCM pump decreases. Consequently, the duration to evacuate the emissions control system is reduced. Therefore, restriction of a canister filter may be diagnosed based on a duration to evacuate the canister side of the evaporative emissions control system to a reference pressure being less than a threshold duration, where the threshold duration is based on a duration to evacuate a new canister filter.

If the canister is partially restricted, the entire volume of the canister side is accessible to the ELCM pump. However, the ELCM pump may take a longer duration to evacuate the canister side of the evaporative emissions control system as the restricted filter may decrease the evacuation rate. Therefore, if the canister is partially restricted, the duration to evacuate the canister side to the reference pressure is greater than a second threshold duration, where the second threshold duration is greater than the first threshold duration.

Further, when the canister side of the evaporative emissions control system is at the reference pressure, an initial pressure difference across the canister at a time when the purge valve is commanded open may further indicate if the canister is partially restricted or fully restricted. For example, if the canister filter is fully restricted, the initial pressure difference across the canister, as measured by a MAP sensor and an ELCM pressure sensor, may be greater than a threshold difference. If the canister filter is partially restricted, the initial pressure difference is less than the threshold. If partial restriction of the canister filter is confirmed, a vehicle controller may estimate a remaining life time of the canister filter by monitoring a rate of vacuum decay and a duration for the evaporative emissions control system to stabilize to the atmospheric pressure after opening the purge valve.

In this way, an existing ELCM pump that is utilized for evaporative emissions leak detection routines is also utilized to diagnose a canister filter. By diagnosing restriction of the canister filter and estimating a remaining lifetime of the canister filter, a vehicle operator may be altered of a failing canister filter condition and prompted to take corrective actions (such as replacing the canister filter or cleaning the canister filter) before the canister becomes fully restricted, thus saving on warranty and/or repair costs. Further, if canister filter restriction is diagnosed, evaporative emissions leak diagnostics may not be performed until corrective actions are taken, thereby reducing evaporative emissions leak diagnostics failure due to clogged canister filter. Still further, by diagnosing canister filter restriction, and taking necessary corrective actions based on the diagnosis, purging efficiency may be maintained at a desired level. Consequently, emissions may be reduced and fuel economy may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for diagnosing a canister filter integrated within a fuel vapor canister. Specifically, this description relates to systems and methods for diagnosing a canister filter within a fuel vapor canister during an engine-off condition. The fuel vapor canister may be included in a plug-in hybrid vehicle (PHEV), such as the PHEV schematically depicted in FIG. 1. The fuel vapor canister may be included in an evaporative emissions system coupled to a fuel system, as shown schematically in FIG. 2. The evaporative emissions system may include an evaporative leak check module (ELCM), operable in multiple conformations. The ELCM may be utilized to diagnose a canister filter. During certain engine-off conditions, a controller, such as controller 212 at FIG. 2 may be configured to perform control routines according to the methods of FIGS. 3-5 to diagnose restriction of a canister filter, to diagnose a degree of restriction of the canister filter, and to estimate a remaining lifetime of the canister filter respectively. An example timeline for estimating a remaining lifetime of the canister filter is shown at FIG. 6

Figure 1:
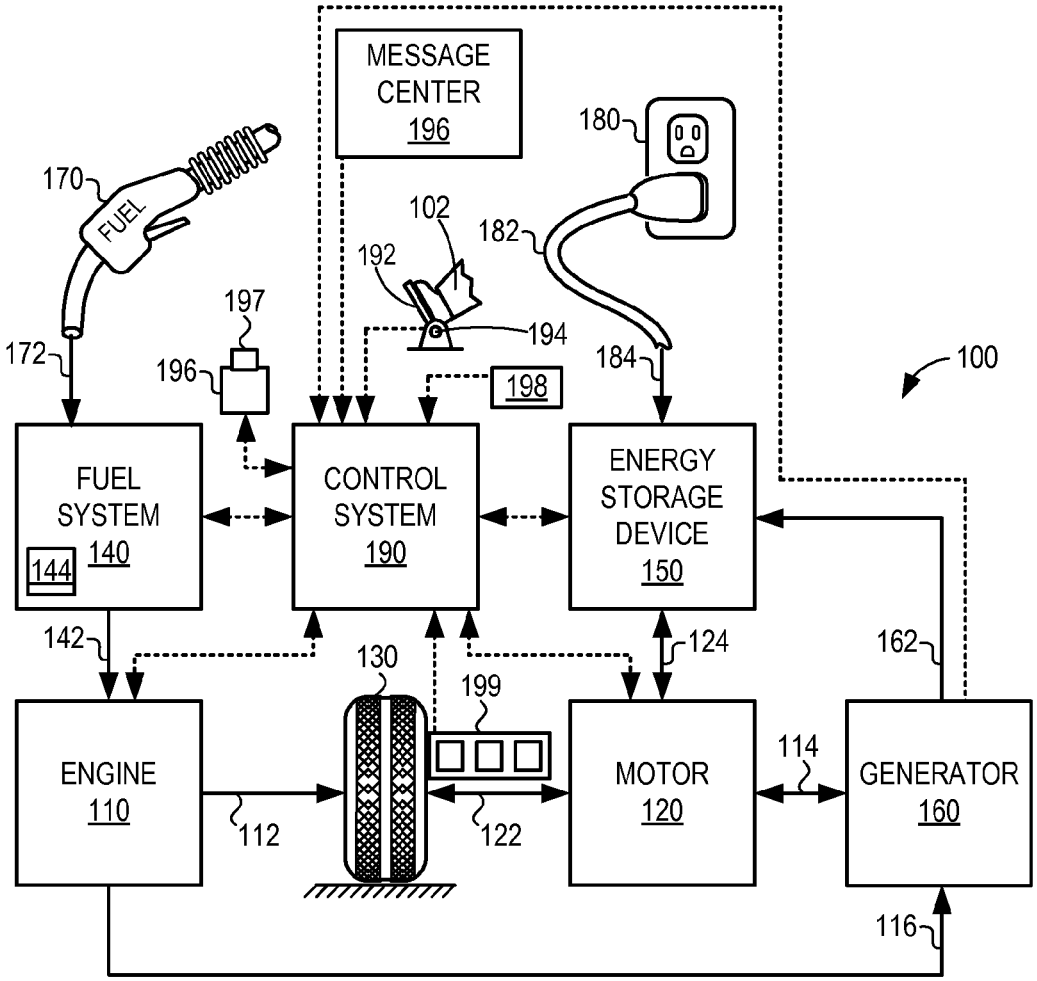
FIG. 1 schematically shows an example vehicle propulsion system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIGS. 3-5, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed. In one example, vehicle instrument panel 196 may indicate a restriction of a canister filter integrated within a fuel vapor canister coupled to the fuel tank. The indication of the restriction may be based on a diagnosis of the canister filter during an engine-off condition and may include an indication of partial or full restriction of the canister filter, and may further include an estimate of a remaining lifetime of the canister filter. Details of diagnosing a canister filter will be further elaborated herein with respect to FIGS. 3, 4, and 5.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

Figure 2:
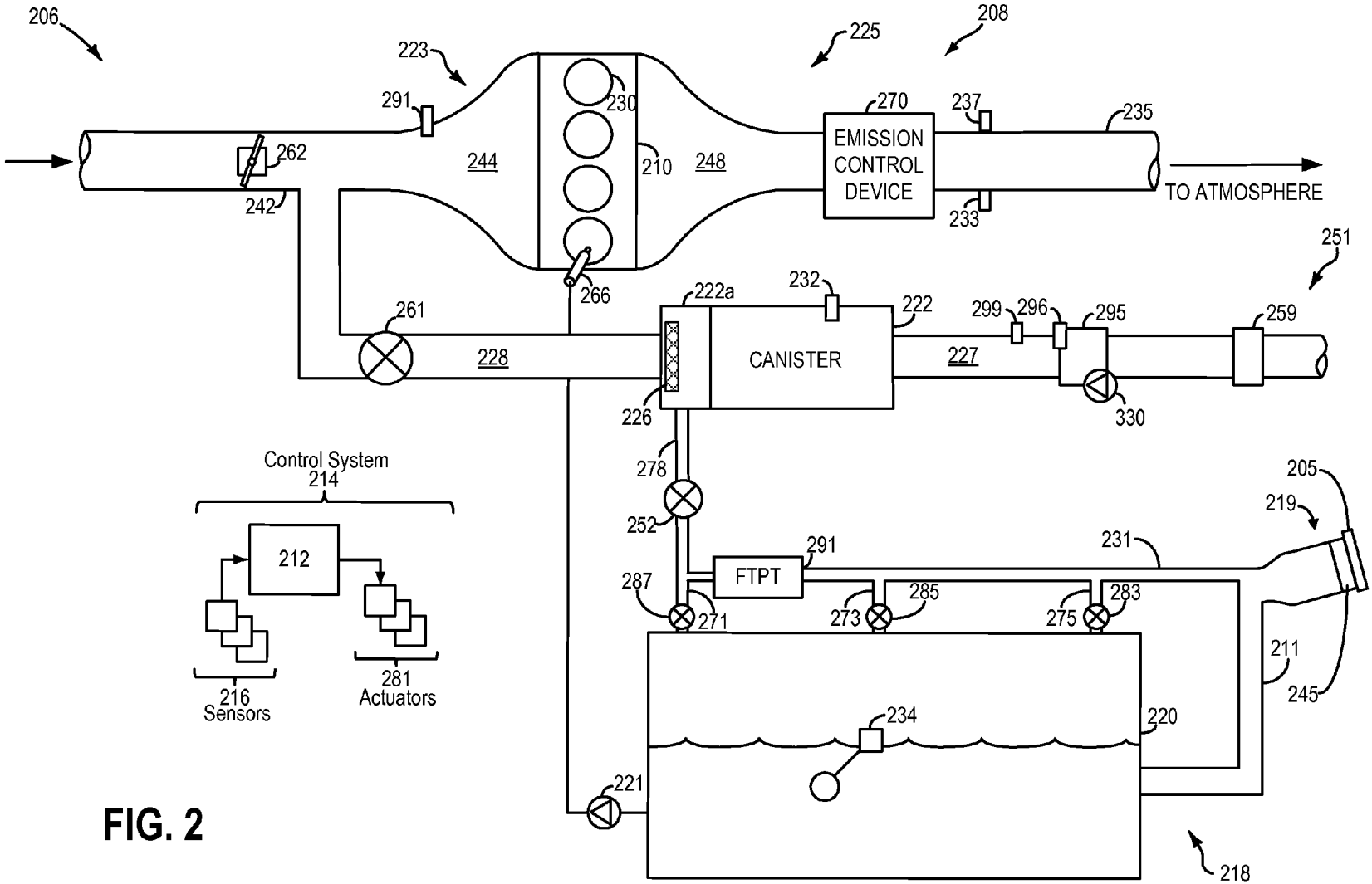
FIG. 2 schematically shows an example vehicle system with a fuel system and an evaporative emissions system.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222.

Canister 222 may include a canister filter 226 integrated within the canister. Canister filter 226 may be disposed near a purge port that couples the canister with purge line 228. Canister filter may reduce migration of carbon dust (such as, carbon dust resulting from break down of carbon pellets that trap hydrocarbons) from canister 222 to purge line 228, and thus reduce clogging of purge valve 261 with carbon dust.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. During certain conditions, when the canister filter becomes restricted, vacuum from the intake manifold may not reach the canister, resulting in an inability to purge. Therefore, diagnosis of the canister filter may be performed as discussed in detail below to diagnose restriction of the canister filter and to estimate a remaining life time of the canister filter.

In some examples, vent line 227 may include an air filter 259 disposed therein upstream of a canister 222. In some examples, the flow of air and vapors between canister 222 and the atmosphere may be regulated by a canister vent valve coupled within vent line 227. For example, the canister vent valve may be coupled within vent line 227 at a location between an ELCM 295 and filter 259. When included, the canister vent valve may be a normally open valve, so that fuel tank isolation valve 252 (FTIV) may control venting of fuel tank 220 with the atmosphere. FTIV 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252 while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 212 may open canister purge valve 261 while closing isolation valve 252. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include a manifold absolute pressure (MAP) sensor 291, and an ELCM pressure sensor 296. Other sensors such as pressure, temperature, air/fuel ratio, and composition sensors may be coupled to various locations in the vehicle system 206. As another example, the actuators may include fuel injector 266, purge valve 261, throttle 262, fuel tank isolation valve 253, a pump within ELCM 295, vent valve (not shown), and refueling lock 245. The control system 214 may include a controller 212. The controller may receive input data from the various sensors, process the input data, and trigger the actuators in response to the processed input data based on instruction or code programmed therein corresponding to one or more routines. Example control routines are described herein with regard to FIGS. 3-5.

Leak detection routines may be intermittently performed by controller 212 on fuel system 218 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 295 communicatively coupled to controller 212. ELCM 295 may be coupled in vent 227, between canister 222 and the atmosphere. ELCM 295 may include a vacuum pump 330 for applying negative pressure to the fuel system when administering a leak test. In some embodiments, vacuum pump 330 may be configured to be reversible. In other words, vacuum pump 330 may be configured to apply either a negative pressure or a positive pressure on the fuel system. ELCM 295 may further include a reference orifice and a pressure sensor 296. Following the applying of vacuum to the fuel system, a change in pressure at the reference orifice (e.g., an absolute change or a rate of change) may be monitored and compared to a threshold. Based on the comparison, a fuel system leak may be diagnosed. A hydrocarbon sensor 299 may be coupled at or near ELCM 295 within vent line 227.

In some embodiments, vacuum pump 330 included within ELCM 295 may be utilized to evacuate the evaporative emissions control system for diagnosing canister filter restriction, a degree of restriction, and predicting a remaining life time of canister filter 226. For example, restriction of canister filter 226 may be diagnosed based on a duration for the pump to evacuate a canister side of evaporative emissions control system 251 to a reference pressure. The canister side includes canister 222 and a portion of evaporative emissions control system 251 between purge valve 261 and FTIV 252 when purge valve 261 and FTIV 252 are closed. Further, a degree of restriction of canister filter 226 may be determined based on an initial pressure drop across the canister when the purge valve is opened upon reaching the reference pressure. Still further, an estimate of a remaining life of canister filter 226 may be determined based on a rate of vacuum decay and a duration for the evaporative emissions control system to stabilize to the atmospheric pressure from the reference pressure after opening purge valve 261.

ELCM 295 may further include a changeover valve (COV) (not shown), in addition to pump 330, and pressure sensor 296. COV may be moveable between a first and a second position. In the first position, air may flow through ELCM 295 via a first flow path. In the second position, air may flow through ELCM 295 via a second flow path. The position of COV may be controlled by a solenoid via compression spring. Further, the reference orifice in the ELCM may have a diameter corresponding to the size of a threshold leak to be tested, for example, 0.02". In either the first or second position, pressure sensor 296 may generate a pressure signal reflecting the pressure within ELCM 295. Operation of pump 330 and the solenoid may be controlled via signals received from controller 212.

During determination of the reference pressure, the COV is in the first position, and pump 330 is activated in a first direction. Fuel tank isolation valve 252 is closed, isolating ELCM 295 from the fuel tank. Air flow through ELCM 295 in this configuration is represented by arrows. In this configuration, pump 330 may draw a vacuum on reference orifice 340, and pressure sensor 296 may record the vacuum level within ELCM 295. This reference check vacuum level reading may then become a reference pressure for diagnosing restriction of a canister filter. The reference check vacuum level may also become a threshold for passing/failing a subsequent leak test. In other words, pump 330 may be operated for a duration to draw air from the emission control system through orifice 340 in order to obtain a reference pressure for canister filter diagnostics and for detecting leaks in the emission control system. The reference pressure may be compensated for environmental conditions such as temperature, altitude, fuel level, etc.

During diagnosing canister restriction, the COV is in the second position, and pump 330 is activated in the first direction. This configuration allows pump 330 to draw a vacuum on evaporative emissions control system 251. Purge valve 261 may be closed, and FTIV 252 may be closed to allow pump 330 to isolate pump 330 from fuel tank 220. In this configuration, the pump may be operated to draw air from emission control system 251 through the pump and to the atmosphere while bypassing the orifice 340. In this scenario, pressure in emission control system 251 decreases while pump 330 is in operation and the pressure in emission control system 251 may be monitored by pressure sensor 296 and a duration to reach the reference pressure may be monitored for diagnosing canister filter restriction. For example, if the duration to reach the reference pressure is less than a threshold duration, restriction of canister filter 226 may be indicated.

During estimation of a remaining life time of canister filter 226, the COV is in the first position, and pump 330 is de-activated. This configuration allows for air to freely flow between atmosphere and canister 222. Upon evacuating evaporative emissions control system 251 (with purge valve 261 closed and FTIV 252 closed) to the reference pressure, the purge valve may be opened and a rate of vacuum decay and a duration to stabilize to the atmospheric pressure may be monitored for the estimation of the remaining lifetime of canister filter 226. Further, at a time point when purge valve 261 is opened (that is, when purge valve 261 is changed from a closed position to a fully open position), a ELCM pressure sensor output of pressure sensor 296 and a MAP sensor output of MAP sensor 291 may be monitored to determine an initial pressure drop across the canister. The initial pressure drop may provide an indication of whether the canister filter is partially restricted or fully restricted. For example, if it is determined that the initial pressure drop is greater than a threshold difference, full restriction of the canister filter may be indicated; otherwise partial restriction of the canister filter is indicated. Still further, this configuration may also be used during a canister purging operation, for example.

In this way, a pump (such as pump 330) coupled with a leak check module (such as ELCM 295) may be utilized for diagnosing a canister filter (such as canister filter 226) integrated within a fuel vapor canister (such as canister 222).

Details of diagnosing a restriction of a canister filter, a degree of restriction, and estimating a remaining lifetime of a canister filter will be further elaborated with respect to FIGS. 3-6.

In one example, the systems of FIGS. 1, and 2 may enable a system for a hybrid electric vehicle, comprising: an emissions control system including a fuel vapor canister, a purge line coupling the canister with an engine via a purge valve, and a conduit coupling the canister with a fuel tank via a fuel tank isolation valve; an integrated filter included within the canister; a pump coupled within an evaporative leak check module coupled within a vent line coupled between a vent port of the canister and atmosphere; an orifice in the evaporative check module; a pressure sensor in the evaporative check module; a controller with instructions stored in non-transitory memory, that when executed, cause the controller to: during an engine off condition: operate the pump to draw air from the emission control system through the orifice to obtain a reference pressure; close the purge valve, and close the FTIV; and diagnose a restriction in the integrated filter based a first duration for the pump to evacuate a canister side of the emissions control system between the closed purge valve and the closed FTIV to the reference pressure.

The controller is further configured with instructions stored in non-transitory memory, that when executed, cause the controller to: in response to diagnosing the restriction, close the purge valve, close the FTIV, and operate the pump to evacuate the canister side of the emissions control system to the reference pressure; open the purge valve, and estimate a remaining lifetime of the integrated filter based on a second duration for a pressure in the evaporative emissions control system to reach atmospheric pressure from the reference pressure and a rate of pressure increase in the evaporative emissions control system. Still further, the controller is configured with instructions stored in non-transitory memory, that when executed, cause the controller to: in response to diagnosing the restriction, close the purge valve, close the FTIV, and operate the pump to evacuate the canister side of the emissions control system to the reference pressure; command the purge valve to open; when the purge valve moves from a closed position to a full open position, measure a difference between a MAP sensor output and a evaporative check module pressure sensor output; indicate partial restriction of the integrated filter in response to the difference being less than a threshold difference; and indicate full restriction of the integrated filter in response to the difference being greater than the threshold difference.

Figure 3:
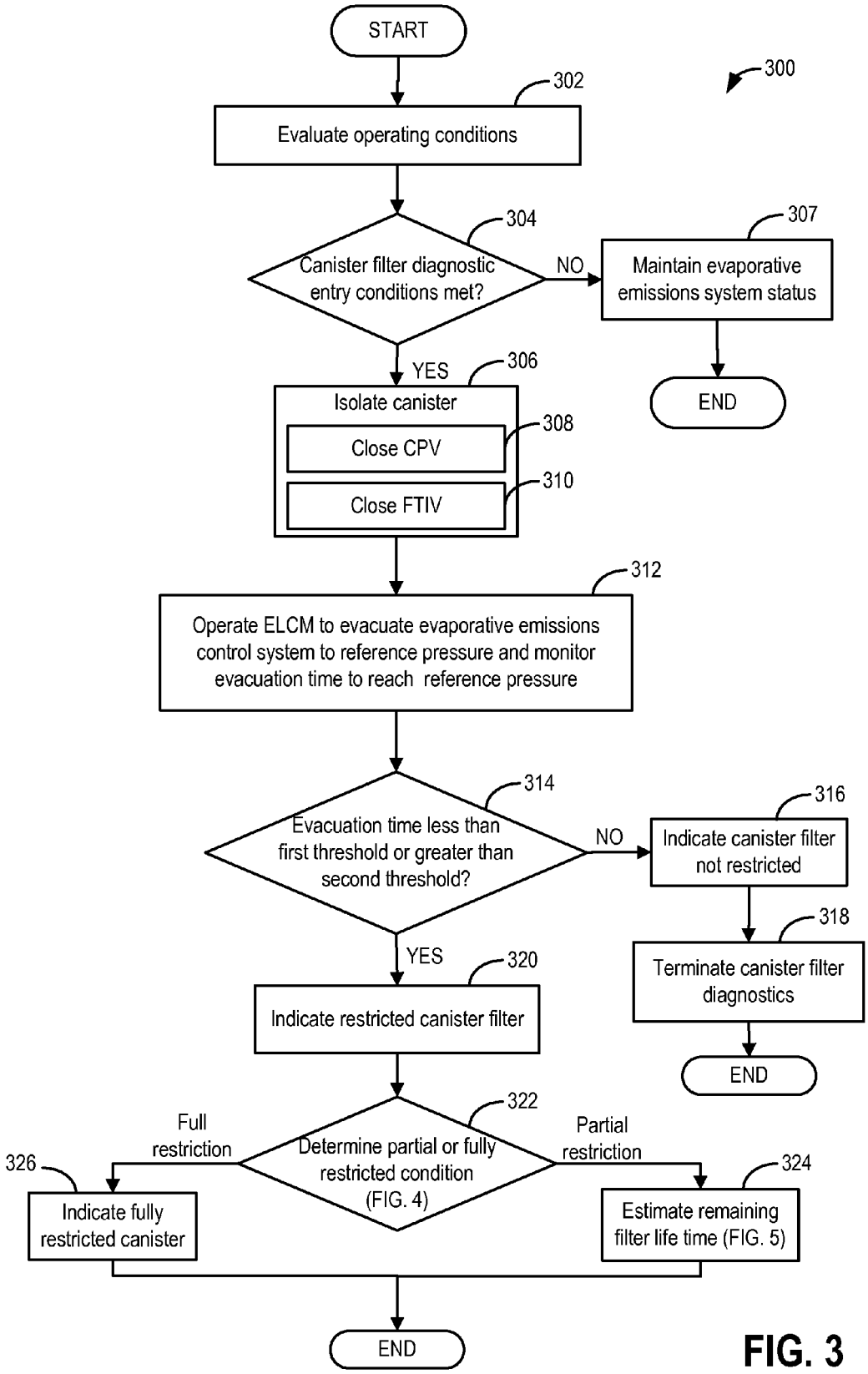
FIG. 3 shows a flow chart for an example method for determining canister filter restriction.

FIG. 3 shows a flow chart for an example high-level method 400 for performing canister filter diagnostics utilizing an ELCM (such as ELCM 295) in a plug-in hybrid vehicle in accordance with the present disclosure. Method 300 will be described with relation to the systems shown in FIG. 2, but it should be understood that similar methods may be used with other systems without departing from the scope of this disclosure. Method 300 may be stored as instructions in non-transitory memory and carried out by a controller, such as controller 212 shown at FIG. 2. Instructions for carrying out method 300 and the rest of the methods included herein may be executed by a controller (such as controller 212) based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

Method 300 may begin at 302 by estimating operating conditions. Operating conditions may include various vehicle conditions, such as vehicle operating mode, etc., various engine operating conditions, such as engine operating mode, etc., and various ambient conditions, such as temperature, barometric pressure, humidity, date, time, etc. In addition to engine conditions, fuel system conditions may also be monitored, such as fuel tank pressure, etc. Operating conditions may be measured by one or more sensors coupled to a controller, such as sensors 16 shown coupled to controller 12, or may be estimated or inferred based on available data.

Method 300 proceeds to 304 after evaluating operating conditions. At 304, method 300 includes determining if entry conditions for performing a canister filter diagnosis are present. In one example, canister filter diagnostic conditions may include engine-off conditions following a vehicle key-off event. In another example, canister filter diagnostic conditions may include engine-off conditions while the vehicle is being operated using an auxiliary power source. For example, in hybrid vehicle applications, engine-off conditions may occur during vehicle operation while the vehicle is in motion with the engine-off. In another example, entry conditions may be based on an amount of time or distance driven since a previous canister filter diagnosis greater than a threshold amount of time. In still another example, canister filter diagnosis may be based on leak testing in an emission control system and/or a fuel system. For example, canister filter diagnosis may be performed prior to performing an engine-off EVAP leak test when EVAP leak test entry conditions are met. As such, the leak test may be performed during engine-off conditions when operating conditions indicate that ambient temperature, barometric pressure, and/or fuel tank level are in a range for performing the test.

If entry conditions are not present at 304, method 300 proceeds to 307. At 307, method 300 includes maintaining an evaporative emissions system status. For example, a FTIV and a CVV may be maintained in open positions during vehicle-off and engine-off conditions to direct diurnal vapors from the tank to the canister, and to vent the air stripped of fuel vapors to the atmosphere via the canister vent valve. Method 300 may then end.

If entry conditions are present at 306, method 300 proceeds to 306. At 306, method 300 includes isolating the canister from the engine and the fuel tank by closing a purge valve (such as purge valve 261) at 308, and closing a FTIV (such as FTIV 252) at 310 respectively. A vent valve (not shown) may be maintained in an open position. Next, method 300 proceeds to 312. At 312, method 300 includes operating the ELCM to evacuate the evaporative emissions control system including a portion of a purge line (such as purge line 228) between the purge valve and the canister, the canister, a portion of a conduit between the canister and the FTIV (such as line 278), and a canister vent line (such as vent line 227) leading up to the atmosphere. The reference pressure may be determined prior to performing the canister filter diagnostics when canister filter entry conditions are met by operating the ELCM to draw air from the evaporative emissions control system through a reference orifice. For example, pump 324 in module 295 may be actuated while change over valve 320 is depowered in the first position. The pump is located in a vent path of a fuel vapor canister in the emission control system and draws a quantity of air from the emission control system through the reference orifice 340 to obtain a reference pressure based on the size or diameter of the orifice. Further, at 312, method 300 includes monitoring an evacuation time to reach reference pressure.

Next, at 314 method 300 includes determining if the evacuation time is less than a first threshold or greater than a second threshold. The first threshold is based on a time to evacuate an emissions control system including a canister comprising a new canister filter. For example, the first threshold may be determined during a manufacturing process and stored in a memory of the controller. Specifically, the first threshold may be established in the assembly plant at an end of line station. In another example, the first threshold may be determined when the vehicle is in service when the canister/filters are replaced. The second threshold is greater than the first threshold and may be based on the first threshold. For example, in an evaporative emissions system with integrity, if the canister filter is fully clogged, a volume of the evaporative emissions control system that is accessible by the pump in the ELCM decreases, and therefore, a time to evacuate the evaporative emissions control system to the reference pressure may be less than the first threshold. However, if the canister is partially restricted (greater than a threshold percentage of restriction, for example), it may take a substantially longer duration to evacuate the evaporative emissions control system as the partially restricted filter may impede flow through the canister.

If the evacuation time is between the first threshold and the second threshold, it may be determined that the canister filter is not restricted. Accordingly, method 300 proceeds to 316 at which method 300 indicates canister filter is not restricted. Indicating that the fuel vapor canister filter is not restricted may include setting a flag or code at controller 12. Upon indicating that the canister filter is not restricted, method 300 proceeds to 318. At 318, method 300 may terminate canister filter diagnostics and may return to maintaining the evaporative emissions system status as discussed at 307.

If the answer at 314 is YES, it may be confirmed that the canister filter is restricted. Accordingly, at 320, method 300 includes indicating restriction of the canister filter. Indicating a restriction of the canister filter may include setting a flag or code at controller 12. Upon indicating canister filter restriction, method 300 proceeds to 322 to determine if the canister filter is fully restricted or partially restricted. The determination of partial or full canister filter restriction may be based on an initial pressure difference across the canister. Details of determining if the canister filter is partially or fully restricted will be further elaborated with respect to FIG. 4.

If it is determined that the canister filter is partially restricted, method 300 proceeds to 324. At 324, method 300 includes estimating a remaining life time of the canister filter, details of which will be elaborated with respect to FIG. 5.

If it is determined that the canister filter is fully restricted, method 300 proceeds to 326. At 326, method 300 includes indicating that the canister is fully restricted. Indicating a full restriction in the fuel vapor canister filter may include setting a flag or code at controller 12, and may further include illuminating an MIL. Further, the vehicle operator may be prompted to take corrective actions. Still further, upon indicating full restriction of a canister filter, the controller may suspend leak diagnostics until corrective actions (such as replacing the canister filter or cleaning the canister filter) are performed.

Figure 4:
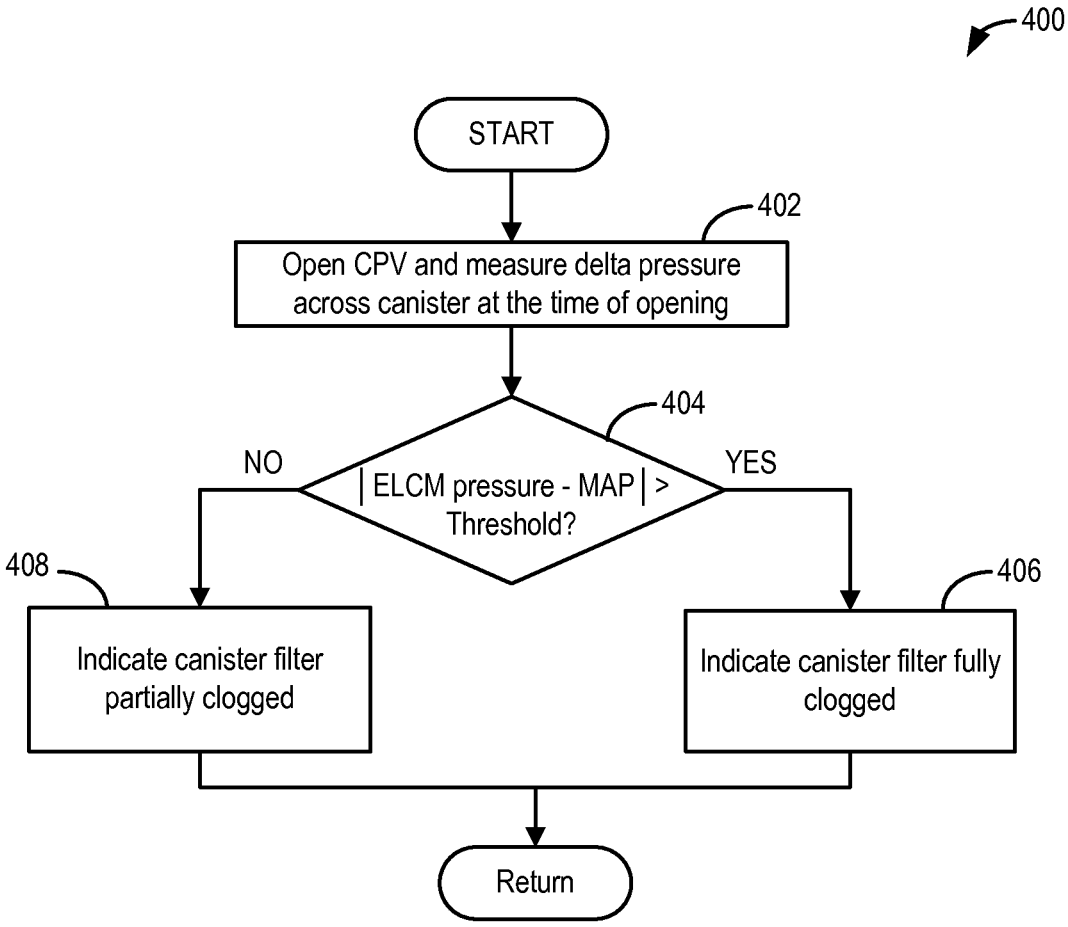
FIG. 4 shows a flow chart for an example method for determining a degree of canister filter restriction.

Turning to FIG. 4, a flow chart for an example high-level method 400 for determining a degree of restriction of a fuel vapor canister filter (such as canister filter 226 at FIG. 2) is shown. Specifically, method 400 may include determining if the fuel vapor canister filter is fully restricted or partially restricted. Method 400 will be described with relation to the systems shown in FIG. 2, but it should be understood that similar methods may be used with other systems without departing from the scope of this disclosure. Method 400 may be stored as instructions in non-transitory memory and carried out by a controller, such as controller 212 shown at FIG. 2.

Method 400 may continue from 322 at FIG. 3. At 322, the canister side run is at reference pressure. Further, at 322, the purge valve is in a closed position, the FTIV is in a closed position, and the CVV is an open position. Method 400 may begin at 402. In order to determine if the canister filter is partially or fully restricted, at 402, method 400 includes opening the purge valve and measuring a pressure difference across the canister at the time of the opening. The pressure difference is determined based on a MAP sensor output from a MAP sensor (such as sensor 291 at FIG. 2) and an ELCM pressure sensor output from an ELCM pressure sensor (such as pressure sensor 296 at FIG. 2) at a time when the purge valve is commanded open.

Next, at 404, method 400 includes determining if the pressure difference |ELCM pressure−MAP| across the canister is greater than a threshold pressure difference. The pressure difference across the canister at the time of purge valve opening may provide an indication of whether the canister filter is fully restricted or partially restricted. For example, if the canister filter is fully clogged, the pressure drop across the canister at the time of purge valve opening is large compared to the pressure drop when the canister filter is partially clogged. Subsequently, the pressure difference decreases and the MAP sensor output and the ELCM pressure sensor output converge over time.

If the pressure difference is greater than the threshold, method 400 proceeds to 406. At 406, method 400 indicates full restriction of canister filter. Indicating a full restriction of the fuel vapor canister filter may include setting a flag or code at controller 12, and may further include illuminating an MIL. Method 400 then returns to 322 at FIG. 3.

If the pressure difference is less than the threshold, method 400 proceeds to 408. At 408, method 400 includes indicating partial restriction of the canister filter. Indicating partial restriction of the fuel vapor canister filter may include setting a flag or code at controller 12. However, if partial restriction is determined, MIL may not be illuminated. Upon indicating partial restriction, method 400 returns to 322 at FIG. 3.

In this way, MAP sensor output and ELCM pressure sensor output may be utilized to determine full or partial restriction of the canister filter.

Figure 5:
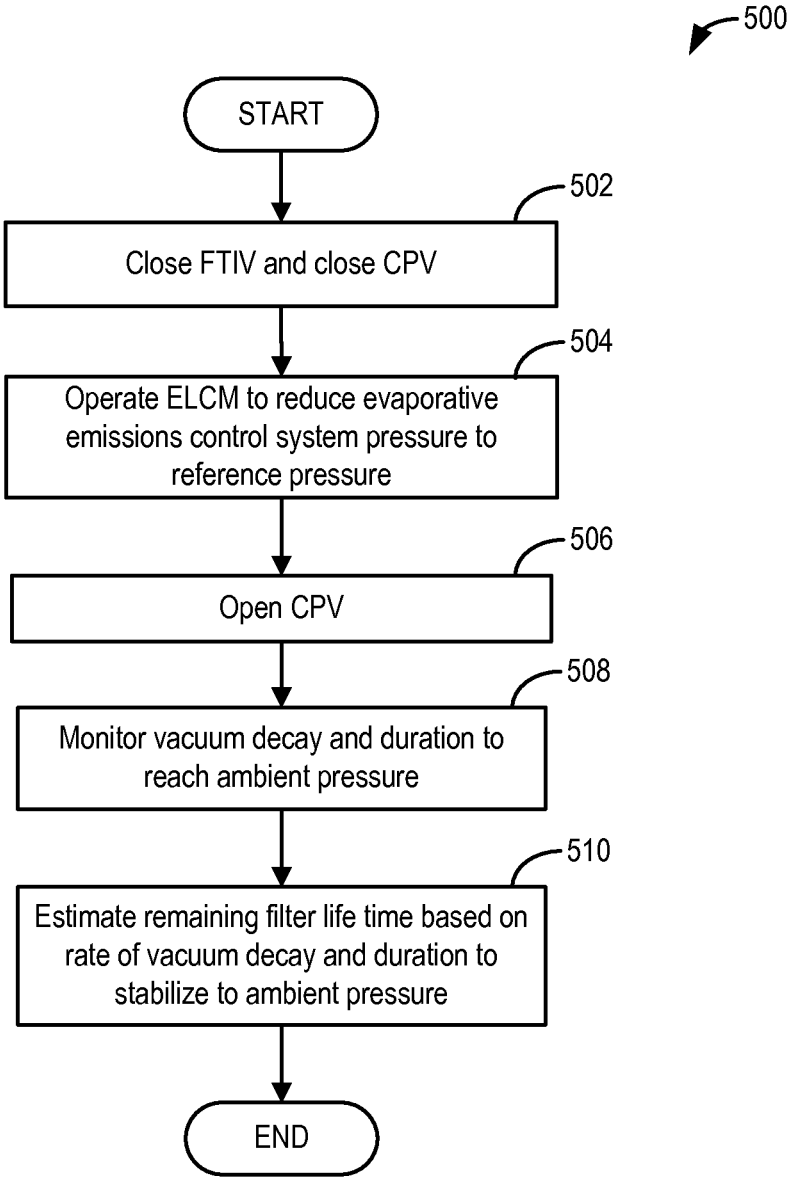
FIG. 5 shows a flow chart for an example method for estimating a remaining life time of a canister filter.
Figure 6:
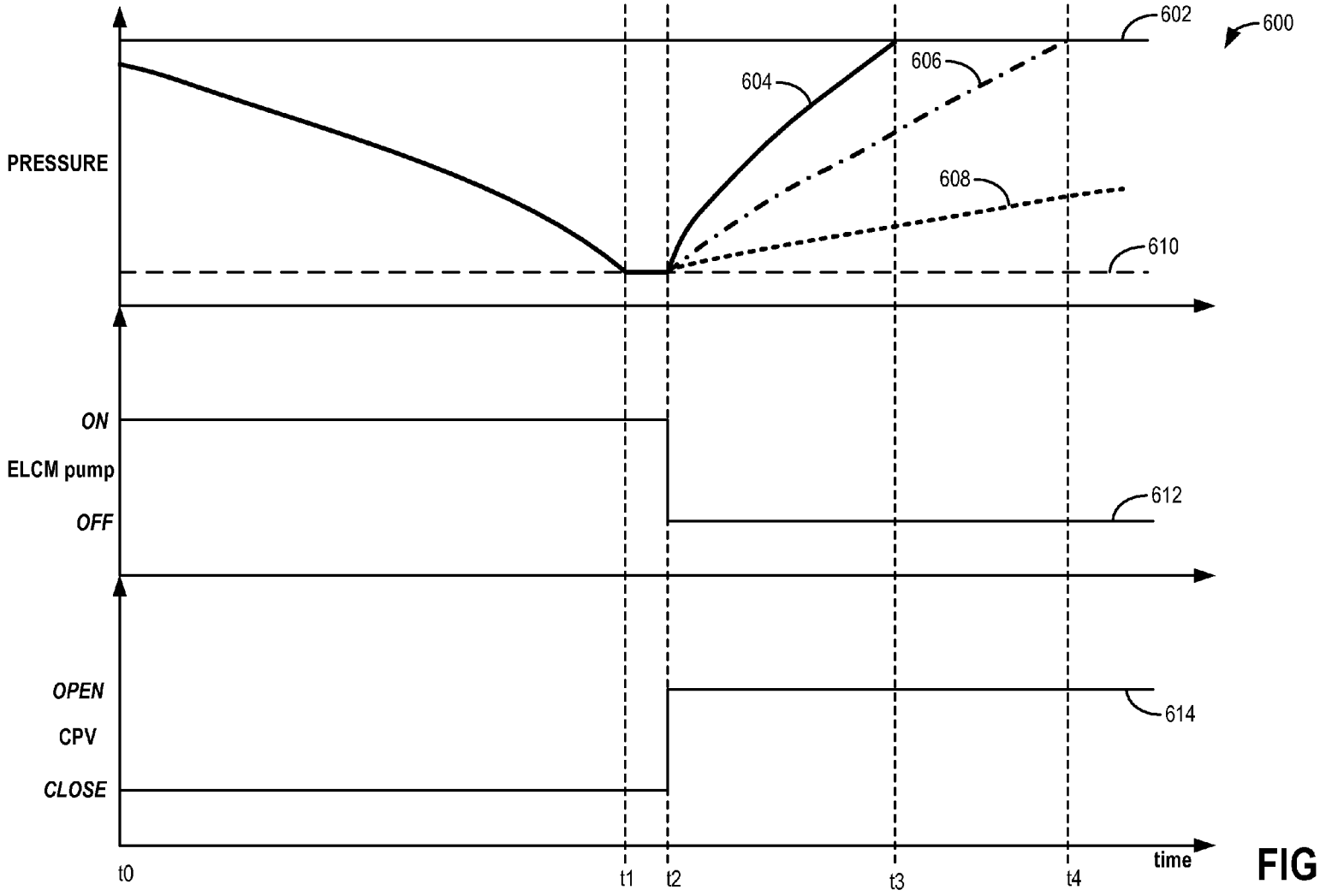
FIG. 6 shows a graph illustrating an example canister filter diagnostic cycle.

Turning to FIG. 5, a flow chart for an example high level method 500 for estimating a remaining life time of a canister filter is shown. Method 500 may be carried out at 324 of FIG. 3 to estimate a remaining lifetime of the canister filter is response to determining partial restriction of the fuel vapor canister. Method 500 will be described with relation to the systems shown in FIG. 2, but it should be understood that similar methods may be used with other systems without departing from the scope of this disclosure. Method 500 may be stored as instructions in non-transitory memory and carried out by a controller, such as controller 212 shown at FIG. 2.

Method 500 begins at 502 by closing a FTIV (such as FTIV 252) and a purge valve (such as purge valve 261) to isolate a canister side volume of an emissions control system (such as emissions control system 251) from a fuel tank (such as fuel tank 220) and an engine (such as engine 210). A vent valve disposed in a vent line (such as vent line 227) may be maintained in an open position.

Next, at 504, method 500 includes operating the ELCM to evacuate the canister side volume of the evaporative emissions control system such that a pressure in the evaporative emissions control system measured by a ELCM pressure sensor output is decreased to a reference pressure. The canister side volume includes a portion of the conduit between the purge valve and the canister, the canister, a portion of the conduit between the canister and the FTIV, and the canister vent line leading up to the atmosphere. The reference pressure may be determined as discussed with respect to 312 and FIG. 2 prior to initiating the canister filter diagnostics. As such, the reference pressure may be obtained by operating the ELCM to draw a quantity of air from the evaporative emissions control system through a reference orifice.

Upon the pressure in the emissions control system reaching the reference pressure, method 500 proceed to 506. At 506, method 500 includes opening the purge valve. Next, at 508, method 500 includes monitoring a rate of vacuum decay (or change in pressure) of the emissions control system and a duration to stabilize to ambient pressure. The rate of vacuum decay of the emissions control system is determined based on the ELCM pressure sensor output.

Next, method 500 proceeds to 510 to estimate a remaining filter life time based on the rate of vacuum decay and the duration to stabilize to ambient pressure. For example, as a percentage of restriction increases, the rate of vacuum decay increases and the duration to stabilize to ambient pressure increases. An example estimation of the filter life time is shown at FIG. 6 discussed below. Upon estimating the remaining life time of the canister filter, method 500 ends.

In this way, the ELCM is utilized to estimate a remaining life time of a canister filter. Turning to FIG. 6, a timeline 600 illustrating an example estimation of a remaining lifetime of a canister filter is shown. Timeline 600 may be provided by executing instructions in the system of FIG. 2, according to the method described at FIG. 5. Vertical markers at times t0-t4 represent times of interest. X axis represents time, and time increases from the left side of the plot to the right side of the plot.

Timeline 600 includes plot 604 indicating change in pressure (vacuum decay) of an evaporative emissions control system versus time for a canister filter without restriction. Timeline 600 further includes plot 606 indicating change in evaporative emissions control system pressure versus time for a canister filter with partial restriction, and includes plot 608 indicating change in emissions control system pressure versus time for a canister filter with full restriction. Horizontal line 602 indicates atmospheric pressure and horizontal line 610 indicates reference pressure. Timeline 600 further includes plot 612 indicating an operating condition (ON or OFF) of a ELCM pump versus time, and includes plot 614 indicating a position (open or closed) of a purge valve versus time. The emissions control system pressure is determined based on an ELCM pressure sensor output.

At time t0, the purge valve is closed and the ELCM pump is turned ON to evacuate a canister side volume of the evaporative emissions control system such that the evaporative emissions control system pressure decreases to a reference pressure. The reference pressure is determined by drawing a quantity of air through a reference orifice.

At time t1, the evaporative emissions control system pressure reaches the reference pressure (610) and between time t1 and t2, the evaporative emissions control system pressure is stabilized at the reference pressure. At t2, the purge valve is opened and the ELCM pump is turned OFF, and a change in evaporative emissions control system pressure (that is, vacuum decay) is monitored. For a canister filter with no restriction, the pressure stabilizes to the atmospheric pressure (602) at time t3 (plot 604). A canister filter that has partial restriction takes a longer duration to stabilize (that is, slower rate of vacuum decay), and therefore the filter with partial restriction stabilizes to the atmospheric pressure at t4 (plot 606). Further, as the restriction in the canister filter increases, the rate of vacuum decay decreases and the duration to stabilize to the atmospheric pressure increases. A canister filter that is fully clogged does not stabilize to the atmospheric pressure, as indicated by plot 610. Therefore, remaining life time of canister filter may be determined based on the rate of vacuum decay and the duration to stabilize to the atmospheric pressure.

In this way, by monitoring a change in the evaporative emissions control system pressure, a remaining lifetime of a canister filter may be estimated.

The system described herein and with regard to FIGS. 1-2, along with the methods described herein and with regard to FIGS. 3-6 may enable one or more systems and one or more methods.

In one example, a method comprises: indicating restriction of an integrated filter of a carbon canister responsive to a duration to reduce a pressure of an evaporative emissions control system to a reference pressure being less than a first threshold duration. The method may further comprise, indicating restriction of the integrated filter based on the duration being greater than a second threshold duration; wherein the second threshold duration is greater than the first threshold duration. The method further includes wherein reducing the pressure of the evaporative emissions control system to the reference pressure comprises isolating a canister side of the evaporative emissions control system by closing a canister purge valve, closing a fuel tank isolation valve, and opening a canister vent valve; and evacuating a volume of air in the canister side by operating a pump located in a vent path of the fuel vapor canister in the evaporative emissions control system. The method further includes wherein the pressure of the evaporative emissions control system is estimated based on an output of a pressure sensor located in the vent path. The method may further comprise, indicating a full restriction of the integrated filter in response to a pressure difference across the canister being greater than a threshold difference at a time point when the purge valve is commanded open after reaching the reference pressure; otherwise indicating a partial restriction of the integrated filter. Still further, the method may comprise estimating a remaining lifetime of the integrated filter in response to indicating partial restriction of the canister filter; wherein the remaining lifetime is estimated based on a rate of vacuum decay and a duration to stabilize to an atmospheric pressure from the reference pressure.

The method includes wherein the pump and the pressure sensor are coupled within an evaporative leak check module; wherein the reference pressure is determined by operating the pump to draw air from the emission control system through a reference orifice; and wherein operating the pump to obtain the reference pressure and reducing the pressure of the canister side is performed during an engine off condition.

In another example, a method may comprise: in response to a duration to reduce a pressure of a portion of an evaporative emissions control system including a fuel vapor canister to a reference pressure being less than a first threshold or greater than a second threshold, diagnosing a restriction in an integrated filter of the canister; and indicating a degree of restriction based on an initial pressure difference across the canister when a canister purge valve is commanded open. The method includes wherein a portion of the evaporative emissions control system comprises a portion of a purge line between the purge valve and the canister, the canister, and a portion of a conduit between the canister and a fuel tank isolation valve coupling the canister with a fuel tank; and wherein the pressure difference across the canister is estimated based on a manifold absolute pressure sensor located in an engine intake manifold, and an evaporative leak check module pressure sensor located in a vent line of the canister.

The method further comprises indicating partial restriction of the integrated filter responsive to the initial pressure difference being less than a threshold; otherwise indicating full restriction of the integrated filter. The method includes wherein reducing the pressure of a portion of the evaporative emissions control system comprises closing the canister purge valve, closing the fuel tank isolation valve, opening the canister vent valve, and operating a pump disposed within the vent line coupling the canister to atmosphere until the reference pressure is reached. The method may further comprise, in response to the duration to reduce the pressure of a canister side to the reference pressure being less than a first threshold or greater than a second threshold, when the evaporative emissions control system is at the reference pressure, opening the canister purge valve and stopping operation of the pump while maintaining the fuel tank isolation valve closed and the canister vent valve opened; and estimating a remaining lifetime of a canister filter based on a second duration for a pressure in the evaporative emissions control system to reach atmospheric pressure from the reference pressure and a rate of change of pressure in the evaporative emissions control system. The method includes wherein the reference pressure is determined by operating the pump to draw air from the emission control system through a reference orifice; and wherein diagnosing the restriction of the integrated filter is performed during an engine off condition; and wherein estimating the remaining lifetime of the integrated filter is performed during an engine off condition.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

indicating restriction of an integrated filter of a carbon canister responsive to a duration for reducing a pressure of an evaporative emissions control system to a reference pressure being less than a first threshold duration.

2. The method of claim 1, further comprising, indicating restriction of the integrated filter based on the duration being greater than a second threshold duration; wherein the second threshold duration is greater than the first threshold duration.

3. The method of claim 2, wherein reducing the pressure of the evaporative emissions control system to the reference pressure comprises isolating a canister side of the evaporative emissions control system by closing a canister purge valve, closing a fuel tank isolation valve, and opening a canister vent valve; and evacuating a volume of air in the canister side by operating a pump located in a vent path of the fuel vapor canister in the evaporative emissions control system.

4. The method of claim 3, wherein the pressure of the evaporative emissions control system is estimated based on an output of a pressure sensor located in the vent path.

5. The method of claim 4, further comprising, when the duration is less than the first threshold or greater than the second threshold, indicating a full restriction of the integrated filter in response to a pressure difference across the canister being greater than a threshold difference at a time point when the purge valve is commanded open after reaching the reference pressure; otherwise indicating a partial restriction of the integrated filter.

6. The method of claim 5, further comprising estimating a remaining lifetime of the integrated filter in response to indicating partial restriction of the canister filter; wherein the remaining lifetime is estimated based on a rate of vacuum decay and a duration to stabilize to an atmospheric pressure from the reference pressure.

7. The method of claim 4, wherein the pump and the pressure sensor are coupled within an evaporative leak check module.

8. The method of claim 4, wherein the reference pressure is determined by operating the pump to draw air from the emission control system through a reference orifice.

9. The method of claim 8, wherein operating the pump to obtain the reference pressure and reducing the pressure of the canister side is performed during an engine off condition.

10. A method, comprising:

in response to a duration to reduce a pressure of a portion of an evaporative emissions control system including a fuel vapor canister to a reference pressure being less than a first threshold or greater than a second threshold, diagnosing a restriction in an integrated filter of the canister; and indicating a degree of restriction based on an initial pressure difference across the canister when a canister purge valve is commanded open.

11. The method of claim 10, wherein a portion of the evaporative emissions control system comprises a portion of a purge line between the purge valve and the canister, the canister, and a portion of a conduit between the canister and a fuel tank isolation valve coupling the canister with a fuel tank.

12. The method of claim 11, wherein the pressure difference across the canister is estimated based on a manifold absolute pressure sensor located in an engine intake manifold, and an evaporative leak check module pressure sensor located in a vent line of the canister.

13. The method of claim 12, further comprising indicating partial restriction of the integrated filter responsive to the initial pressure difference being less than a threshold; otherwise indicating full restriction of the integrated filter.

14. The method of claim 13, wherein reducing the pressure of a portion of the evaporative emissions control system comprises closing the canister purge valve, closing the fuel tank isolation valve, opening the canister vent valve, and operating a pump disposed within the vent line coupling the canister to atmosphere until the reference pressure is reached.

15. The method of claim 14, further comprising, in response to the duration to reduce the pressure of a canister side to the reference pressure being less than a first threshold or greater than a second threshold, when the evaporative emissions control system is at the reference pressure, opening the canister purge valve and stopping operation of the pump while maintaining the fuel tank isolation valve closed and the canister vent valve opened; and estimating a remaining lifetime of a canister filter based on a second duration for a pressure in the evaporative emissions control system to reach atmospheric pressure from the reference pressure and a rate of change of pressure in the evaporative emissions control system.

16. The method of claim 14, wherein the reference pressure is determined by operating the pump to draw air from the emission control system through a reference orifice.

17. The method of claim 16, wherein diagnosing the restriction of the integrated filter is performed during an engine off condition; and wherein estimating the remaining lifetime of the integrated filter is performed during an engine off condition.

18. A system for a hybrid electric vehicle, comprising:

an emissions control system including a fuel vapor canister, a purge line coupling the canister with an engine via a purge valve, and a conduit coupling the canister with a fuel tank via a fuel tank isolation valve;

an integrated filter included within the canister;

a pump coupled within an evaporative leak check module coupled within a vent line coupled between a vent port of the canister and atmosphere;

an orifice in the evaporative check module;

a pressure sensor in the evaporative check module;

a controller with instructions stored in non-transitory memory, that when executed, cause the controller to:

during an engine off condition:

operate the pump to draw air from the emission control system through the orifice to obtain a reference pressure;

close the purge valve, and close the fuel tank isolation valve; and diagnose a restriction in the integrated filter based a first duration for the pump to evacuate a canister side of the emissions control system between the closed purge valve and the closed fuel tank isolation valve to the reference pressure.

19. The system of claim 18, wherein the controller is further configured with instructions stored in non-transitory memory, that when executed, cause the controller to:

in response to diagnosing the restriction, close the purge valve, close the fuel tank isolation valve, and operate the pump to evacuate the canister side of the emissions control system to the reference pressure;

open the purge valve, and estimate a remaining lifetime of the integrated filter based on a second duration for a pressure in the evaporative emissions control system to reach atmospheric pressure from the reference pressure and a rate of pressure increase in the evaporative emissions control system.

20. The system of claim 18, wherein the controller is further configured with instructions stored in non-transitory memory, that when executed, cause the controller to:

in response to diagnosing the restriction, close the purge valve, close the fuel tank isolation valve, and operate the pump to evacuate the canister side of the emissions control system to the reference pressure;

command the purge valve to open;

when the purge valve moves from a closed position to a full open position, measure a difference between a MAP sensor output and a evaporative check module pressure sensor output;

indicate partial restriction of the integrated filter in response to the difference being less than a threshold difference; and indicate full restriction of the integrated filter in response to the difference being greater than the threshold difference.

* * * * *